US006655478B2

(12) United States Patent
Liang et al.

(10) Patent No.: US 6,655,478 B2
(45) Date of Patent: Dec. 2, 2003

(54) FRACTURE AND WEAR RESISTANT ROCK BITS

(75) Inventors: Dah-Ben Liang, Kingwood, TX (US); Gary Portwood, Kingwood, TX (US); Paul E. Cox, The Woodlands, TX (US); John L. Williams, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 68 days.

(21) Appl. No.: 10/017,404

(22) Filed: Dec. 14, 2001

(65) Prior Publication Data

US 2003/0111272 A1 Jun. 19, 2003

(51) Int. Cl.[7] ..... E21B 10/36

(52) U.S. Cl. ..... 175/374; 175/426; 175/420.1; 175/425; 175/428; 51/309; 75/242; 419/18

(58) Field of Search ..... 175/374, 420.1, 175/425, 426, 428; 51/307, 309; 75/236, 240–242; 428/545, 698; 419/18, 48, 49, 64, 66

(56) References Cited

U.S. PATENT DOCUMENTS 5,476,531 A * 12/1995 Timm et al.
5,880,382 A * 3/1999 Fang et al.
6,106,957 A * 8/2000 Fang
6,197,084 B1 * 3/2001 Liang
6,220,375 B1 4/2001 Butcher et al. ..... 175/428
6,244,364 B1 * 6/2001 Ciraveau et al.
6,319,460 B1 * 11/2001 Fang
6,478,887 B1 * 11/2002 Sue et al.

FOREIGN PATENT DOCUMENTS

| | | | |
|---|---|---|---|
| EP | 0 288 775 | 11/1988 | ..... E21C/35/18 |
| GB | 2362406 | 11/2001 | ..... E21B/10/46 |
| WO | WO 97/48876 | 12/1997 | ..... E21B/10/16 |

OTHER PUBLICATIONS

European Search Report, dated Mar. 4, 2003, 1 page.

* cited by examiner

*Primary Examiner*—Roger Schoeppel
(74) *Attorney, Agent, or Firm*—Rosenthal & Osha L.L.P.

(57) ABSTRACT

A fracture and wear resistant rock bit is disclosed, which includes a bit body, and at least one roller cone disposed on the bit body adapted such that at least one row of cutting elements disposed on the at least one roller cone defines a gage row. At least one cutting element disposed on the gage row has a fracture toughness of at least 20 ksi $(in)^{0.5}$ and a wear number of at least 1.5.

17 Claims, 5 Drawing Sheets

| | |
|---|---|
| STDEV | 1.32 |
| Average | 2.5 |
| Max | 8.0 |
| Min | 0.7 |
| Median | 2.0 |

| | |
|---|---|
| STDEV | 1.70 |
| Average | 2.8 |
| Max | 13.3 |
| Min | 0.7 |
| Median | 2.3 |

| | |
|---|---|
| STDEV | 4.01 |
| Average | 5.8 |
| Max | 21.3 |
| Min | 1.3 |
| Median | 4.7 |

| | |
|---|---|
| STDEV | 2.64 |
| Average | 4.9 |
| Max | 16.7 |
| Min | 1.3 |
| Median | 4 |

FRACTURE AND WEAR RESISTANT ROCK BITS

BACKGROUND OF INVENTION

1. Field of the Invention

The invention relates generally to fracture and wear resistant rock bits. More specifically, the invention relates to compositions for inserts used on rock bits which enhance the useful of the bit.

2. Background Art

Drill bits used to drill wellbores through earth formations generally are made within one of two broad categories of bit structures. Drill bits in the first category are generally known as "fixed cutter" or "drag" bits, which usually include a bit body formed from steel or another high strength material and a plurality of cutting elements disposed at selected positions about the bit body. The cutting elements may be formed from any one or combination of hard or superhard materials, including, for example, natural or synthetic diamond, boron nitride, and tungsten carbide.

Drill bits of the second category are typically referred to as "roller cone" bits, which include a bit body having one or more roller cones rotatably mounted to the bit body. The bit body is typically formed from steel or another high strength material. The roller cones are also typically formed from steel or other high strength material and include a plurality of cutting elements disposed at selected positions about the cones. The cutting elements may be formed from the same base material as is the cone. These bits are typically referred to as "milled tooth" bits. Other roller cone bits include "insert" cutting elements that are press (interference) fit into holes formed and/or machined into the roller cones. The inserts may be formed from, for example, tungsten carbide, natural or synthetic diamond, boron nitride, or any one or combination of hard or superhard materials.

Breakage or wear of the inserts, among other factors, limits the longitivity of a drill bit. Inserts used with a rock bit are generally subjected to high wear loads from contact with a borehole wall, as well as high stresses due to bending and impact loads from contact with a borehole bottom. The high wear loads can also cause thermal fatigue in the inserts, which initiates surface cracks on the inserts. These cracks are further propagated by a mechanical fatigue mechanism that is caused by the cyclical bending stresses and/or impact loads applied to the inserts. Fatigue cracks may result in chipping, breakage and failure of inserts.

Inserts that cut the corner of a borehole bottom, such as gage inserts are subject to a significant amount of thermal fatigue. Thermal fatigue is caused by heat generated on the gage side of an insert by friction when the insert engages the borehole wall and slides into a bottom-most crushing position. When the insert rotates away from the bottom, it is quickly cooled by the surrounding circulating fluid. Repetitive heating and cooling of the insert initiates cracking on the outer surface of the insert. Thermal fatigue cracks then propagate through the body of the insert when the crest of the insert contacts the borehole bottom (because of the high contact stresses). The time required to progress from heat checking, to chipping, and eventually to broken inserts depends upon formation type, rotational speed of their bit, and applied weight on bit, among other factors.

The interior rows are also subject to thermal fatigue caused by scraping the borehole bottom. The amount of scraping varies from row to row and is influenced by bit offset and cone to bit speed ratio.

Cemented tungsten carbide generally refers to tungsten carbide (WC) particles dispersed in a binder metal matrix, such as iron, nickel, or cobalt. Tungsten carbide in a cobalt matrix is the most common form of cemented tungsten carbide, which is further classified by grades based on the grain size of WC and the cobalt content.

Tungsten carbide grades are primarily made in consideration of two factors that influence the lifetime of a tungsten carbide insert: wear resistance and toughness. As a result, inserts known in the art are generally formed of cemented tungsten with average grain sizes about less than 3 um as measured by ASTM E-112 method, cobalt contents in the range of about 9–16% by weight and hardness in the range of about 86 Ra to 89 Ra.

For a WC/Co system, it is typically observed that the wear resistance increases as the grain size of tungsten carbide or the cobalt content decreases. On the other hand, the fracture toughness increases with larger grains of tungsten carbide and greater percentages of cobalt. Thus, fracture toughness and wear resistance (i.e., hardness) tend to be inversely related: as the grain size or the cobalt content is decreased to improve the wear resistance of a specimen, its fracture toughness will decrease, and vice versa.

Due to this inverse relationship between fracture toughness and wear resistance (i.e., hardness), the grain size of tungsten carbide and the cobalt content are selected to obtain desired wear resistance and toughness. For example, a higher cobalt content and larger WC grains are used when a higher toughness is required, whereas a lower cobalt content and smaller WC grains are used when a better wear resistance is desired.

SUMMARY OF INVENTION

In one aspect, the present invention relates to a fracture and wear resistant rock bit, which includes a bit body, and at least one roller cone disposed on the bit body adapted such that at least one row of cutting elements rotatably mounted on the at least one roller cone defines a gage row. At least one cutting element disposed on the gage row has a fracture toughness of at least 20 ksi $(in)^{0.5}$ and a wear number of at least 1.5.

Other aspects and advantages of the invention will be apparent from the following description and the appended claims.

DETAILED DESCRIPTION

It has been determined that when drilling certain formations (for example, carbonate formations), inserts having a high fracture toughness with adequate wear resistance and low hardness exhibit improved performance and/or longitivity when compared to conventional inserts. This can be accomplished by using coarse grain carbide grades.

Figure 1:
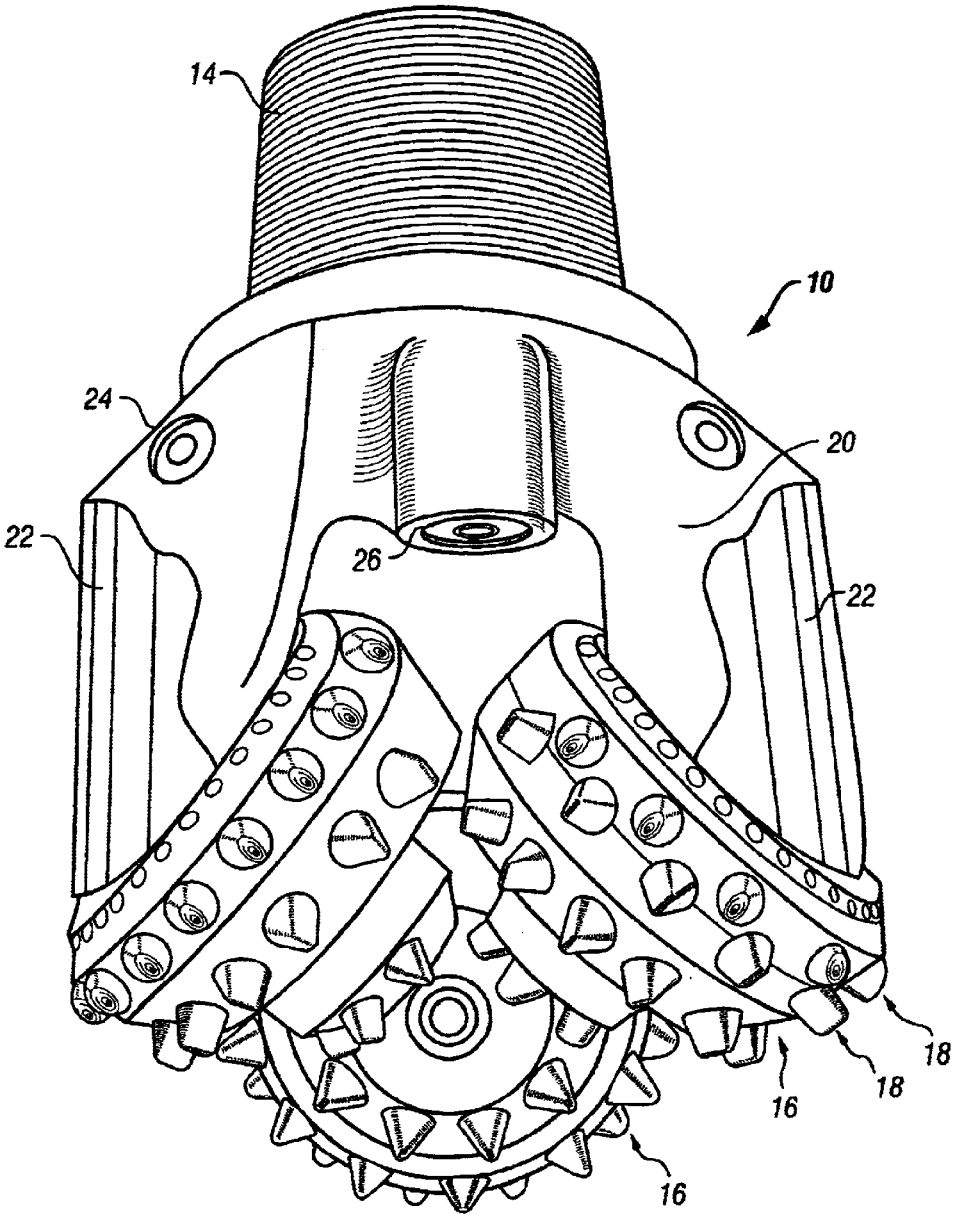
FIG. 1 shows a perspective view of an roller cone drill bit made in accordance with an embodiment of the invention.

FIG. 1 shows a typical roller cone bit used for drilling boreholes in earth formations. The drill bit 10 comprises a bit body 20 and threads 14 formed at an upper end and three legs 22 formed at a lower end. The threads 14 are adapted to couple the bit 10 to a drillstring or bottom hole assembly (BHA) (not shown) used to drill a wellbore (not shown).

Each of three roller cones 16 is rotatably mounted on a corresponding leg 22 proximate the lower end of the bit body 20. A plurality of cutting elements, which in this case comprise inserts 18 that are typically formed from cemented tungsten carbide, are press-fit (or interference fit), brazed, or otherwise affixed in holes (not shown separately in FIG. 1) formed in the roller cones 16. Lubricant for the roller cones 16 is provided to the journals (19 in FIG. 2) on which the roller cones 16 are rotatably mounted from grease reservoirs 24 in the bit body 20. This configuration is generally used for sealed-bearing rock bits. For open-bearing (unsealed) rock bits, such as those typically used in mining applications, there typically are no grease reservoirs.

Figure 2:
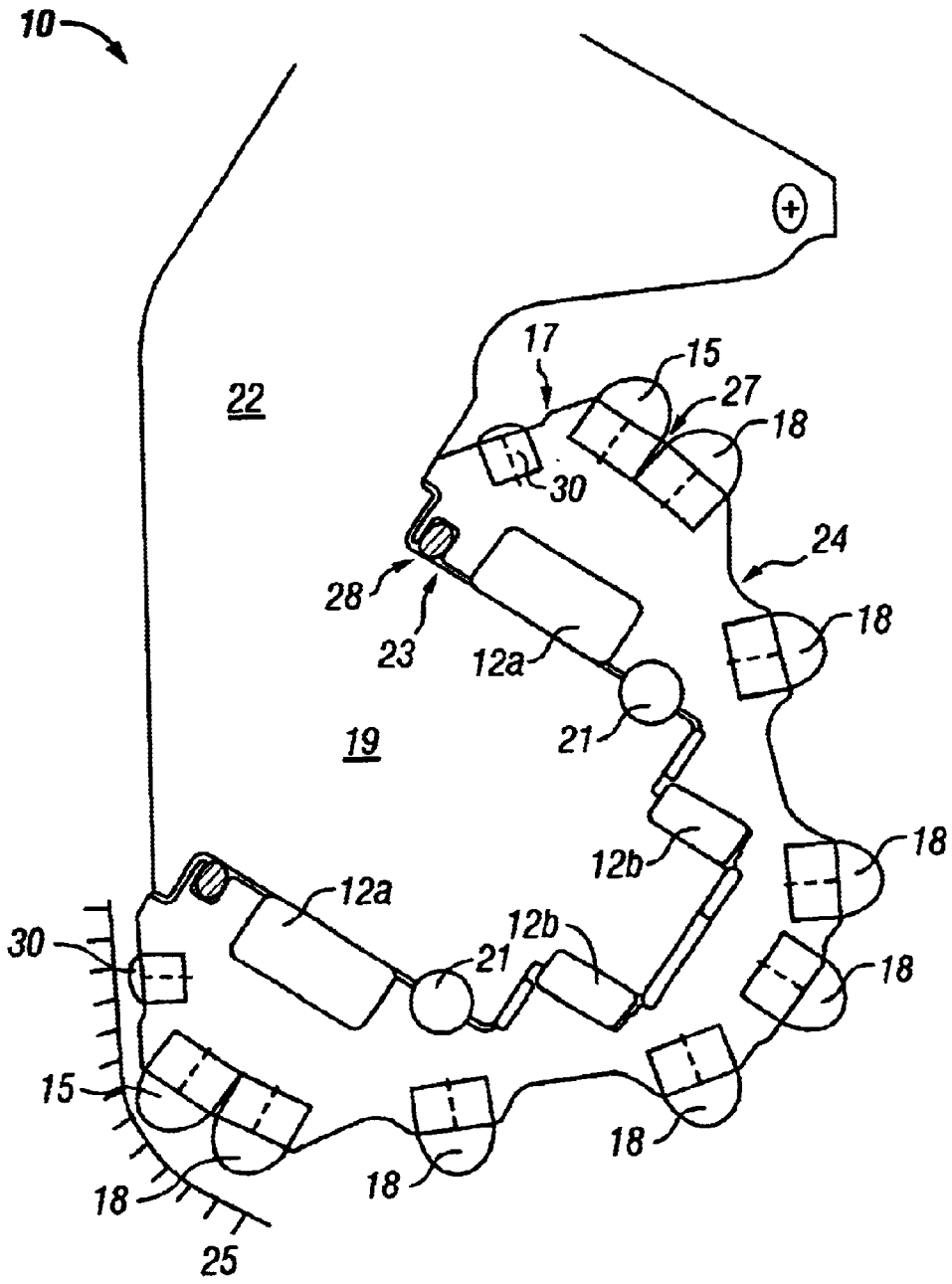
FIG. 2 shows a cross-sectional view of a roller cone in accordance with an embodiment of the invention.

Referring to FIG. 2, when in use, the drill bit 10 is threaded onto a lower end of the drillstring (not shown) and lowered into a wellbore or borehole. The drillstring is rotated by, for example, a rig rotary table (not shown) or a top drive (not shown), and the inserts 18 in the cones 16 engage the bottom and side of the borehole 25. As the bit rotates, the cones 16 rotate on the bearing journals 19 and drill the borehole 25. Weight on bit (WOB) is applied to the drillstring and to the formation by the inserts 18, and the formation is generally crushed and chipped (or scraped) by the inserts 18. A drilling fluid (often referred to as "drilling mud") is usually pumped through the drillstring to the drill bit (10 in FIG. 1) and is ejected through nozzles (26 in FIG. 1) disposed in the bit body (20 in FIG. 1). The drilling fluid then travels up a borehole annulus (not shown) formed between the exterior of the drillstring and the borehole 25 wall. The drilling fluid transports most of the formation cuttings drilled by the bit to the surface. In addition, the drilling fluid serves to cool and clean the inserts 18 and roller cones 16 as the borehole 25 is being drilled.

FIG. 2 also shows a lower portion of the leg 22 that supports a journal bearing 19. A plurality of cone retention balls 21 (e.g., "locking balls") and roller bearings 12*a* and 12*b* surround the journal 19. An O-ring 28, located within in an O-ring groove 23, seals the bearing assembly. The type of seal and roller cone retention device are only shown here to illustrate the general structure of a roller cone drill bit and are not intended to limit the invention.

The cones 16 include multiple rows of the inserts 18, and the roller cones 16 generally include a heel portion 17 located between gage row inserts 15 and the O-ring groove 23. A plurality of heel row inserts 30 are approximately equally spaced about a circumference of the heel 17. The heel row inserts 30 and the gage row inserts 15 act together to drill a gage diameter of the borehole 25. The interior row inserts 18 are generally arranged in, for example, concentric rows, and they serve to crush and chip the earth formations being drilled. Although the geometric shape of the inserts is not critical, it is preferred that they have a semi-round top, a conical top, or a chiseled top.

In one embodiment according to the present invention, at least one gage row insert 15 disposed on the bit 10 comprises a tungsten carbide insert, having a coarse (large) grain size, i.e., an average grain size larger than approximately 4 um as determined by the ASTM E-112 method. Preferably, the insert has a fracture toughness of at least 20 ksi $(in)^{0.5}$ when measured by the ASTM B-771 method. Additionally, the insert has a wear number of at least 1.5 when measured by the ASTM B-611 method. More preferably, the insert also has a hardness range of about 83.0 to about 85.0 Rockwell "A" hardness (Ra). In order to achieve the above fracture toughness and wear resistance, the cobalt content and the grain size of the carbide must be carefully selected.

Typical prior art bits use gage inserts having a toughness of between 12 to 14 ksi $(in)^{0.5}$ and a wear number of 3 to 5. Interior rows of the bits have a higher toughness and wear number than the gage inserts. It was believed that gage inserts needed the wear resistance, because of the large amount of borehole wall contact encountered. Accordingly, toughness was sacrificed to gain wear resistance. This practice, in many applications, led to breakage of the gage inserts with the interior rows still intact. This prior art practice was treating the rock to be drilled by the gage inserts to have the same rock properties in every application. In fact, when drilling carbonate rock, the wear resistance of the gage inserts is not a large concern because carbonate rock is not very abrasive. More important is the gage insert toughness and its ability to resist breakage after thermal fatigue cracks have formed.

In general, embodiments of the invention relate to inserts having a defined cobalt content and an average carbide particle size as measured by ASTM E-112 method. Because tungsten carbide disposed in a cobalt matrix is representative of wear-resistant material, embodiments of the invention are explained with reference to a WC/Co system. However, it should be understood that embodiments of the invention are not limited to a WC/Co system. Specifically, transition metal borides, transition metal carbides, transition metal nitrides, and other transition metal carbides are specifically within the scope of the present invention.

In one embodiment, fracture toughness and wear resistance of an insert having a cobalt content of about 14% and a carbide relative particle size of about 8 were determined. The average carbide particle size as measured by ASTM E-112 method is approximately 4.9 um. This composition, termed "814", exhibited a fracture toughness of about 20 ksi $(in)^{0.5}$ (as measured in accordance with the ASTM B-771 method) and a wear number of about 2 (as measured in accordance with the ASTM B-611 method).

In another embodiment, fracture toughness and wear resistance of an insert having a cobalt content of about 12% and a carbide particle size number of about 9 were determined. The average carbide particle size as measured by ASTM E-112 method is approximately 5.8 um. This composition, termed "912", exhibited a fracture toughness of about 20.2 ksi $(in)^{0.5}$ (as measured in accordance with the ASTM B-771 method) and a wear number of about 1.8 (as measured in accordance with the ASTM B-611 method).

In another embodiment, fracture toughness and wear resistance of an insert having a cobalt content of about 14% and a carbide particle size number of about 9 were determined. The average carbide particle size as measured by ASTM E-112 method is approximately 5.8 um. This composition, termed "914", exhibited a fracture toughness of about 22 ksi $(in)^{0.5}$ (as measured in accordance with the ASTM B-771 method) and a wear number of about 2.2 (as measured in accordance with the ASTM B-611 method).

In another embodiment, fracture toughness and wear resistance of an insert having a cobalt content of about 16% and a carbide particle size number of about 9 were determined. The average carbide particle size as measured by ASTM E-112 method is approximately 5.8 um. This composition, termed "916", exhibited a fracture toughness of about 24 ksi $(in)^{0.5}$ (as measured by the ASTM B-771 method) and a wear number of about 1.8 (as measured by ASTM B-611).

FIGS. 3*a*, 3*b*, 4*a*, and 4*b* show exemplary grain size distributions for compounds "510," "616," "916," and "812," respectively. As the Figures show, all of the compounds have a distribution of grain sizes. The average grain size is listed under the heading "average" in the Figures.

Figure 3A:
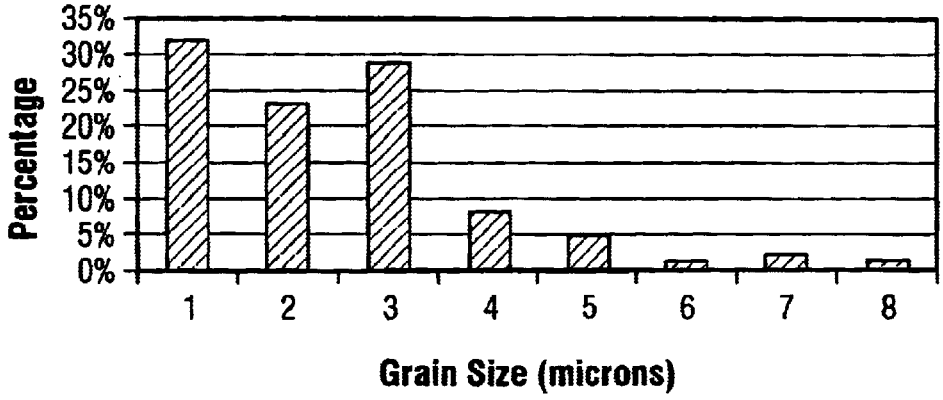
FIGS. 3*a* and 3*b* show exemplary grain size distribution for compositions "510" and "616," respectively.
Figure 3B:
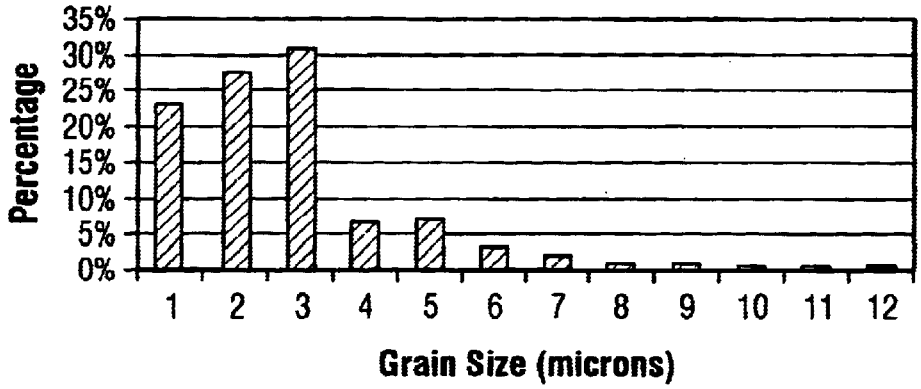
Figure 4A:
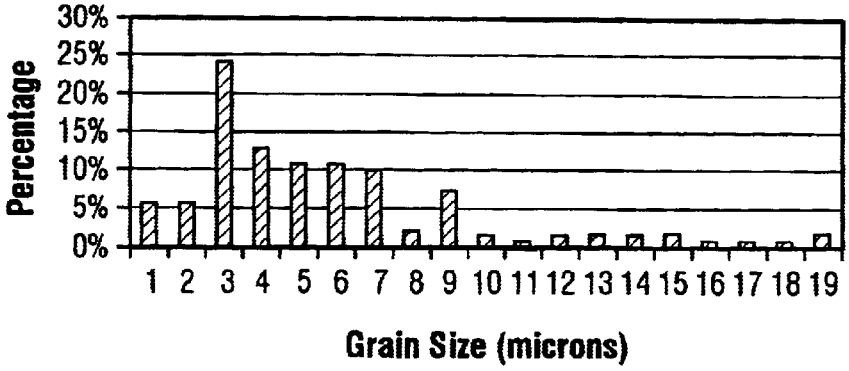
FIGS. 4*a* and 4*b* show exemplary grain size distributions for compositions "916" and "812," respectively.
Figure 4B:
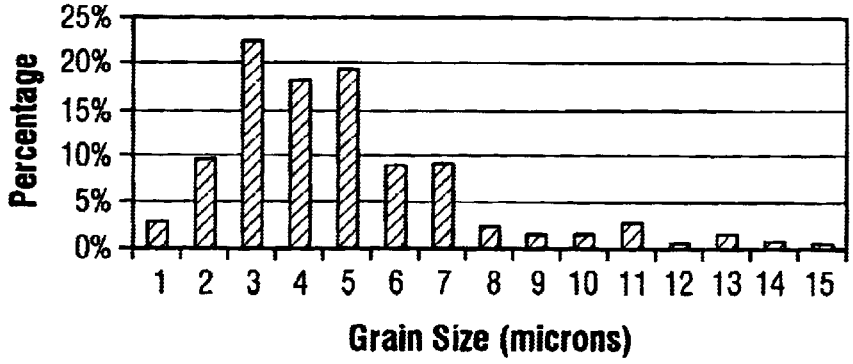

These results were then compared against conventional carbide inserts, which generally use carbides having a relative particle size number of about 3 to about 6 and cobalt content of about 6% to about 16% by weight. The average carbide particle size as measured by the ASTM E-112 method is approximately less than 3.0 um for above conventional carbide inserts. Analogous to the naming convention used in describing the above embodiments, the conventional carbide inserts were given a three digit code name, where the first digit indicates the relative particle size and the latter two digits indicate the cobalt content. Thus, "616" represents an insert having a carbide relative particle size number of 6 and a 16% cobalt content by weight. The average carbide particle size for 616, however, as measured by the ASTM E-112 method, is approximately 2.8 um. FIG. 3*b* shows the results.

Figure 5:
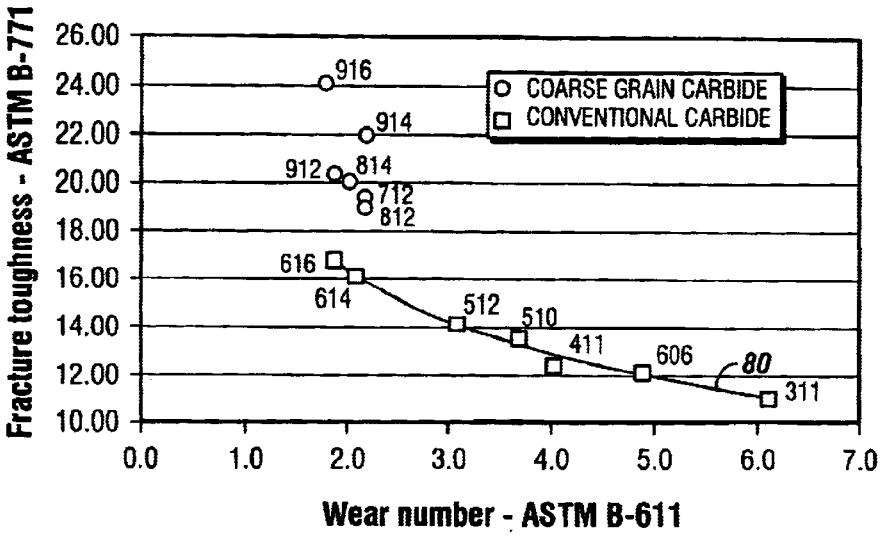
FIG. 5 shows a graphical comparison of fracture toughness vs. wear resistance for conventional carbide bits and carbide bits in accordance with embodiments of the present invention.

In FIG. 5, the conventional carbides (indicated by the compound numbers 616, 614, 512, 510, 411, 606, and 311) are indicated as black squares, while compounds in accordance with the present invention (indicated by the compound numbers 916, 914, 912, 814, 712, and 812) are shown as grey circles. A curve 80 has been plotted through the conventional carbides (indicated by the compound numbers 616, 614, 512, 510, 411, 606, and 311), showing the general trend of conventional bits. As can be seen from the curve, it was believed that increasing fracture toughness was only achieved with a corresponding loss of wear resistance.

In contrast, the trend exhibited by embodiments of the present invention show that both increased fracture toughness and increased wear resistance can be achieved by controlling particle grain size and by using coarse grain carbide.

Figure 6:
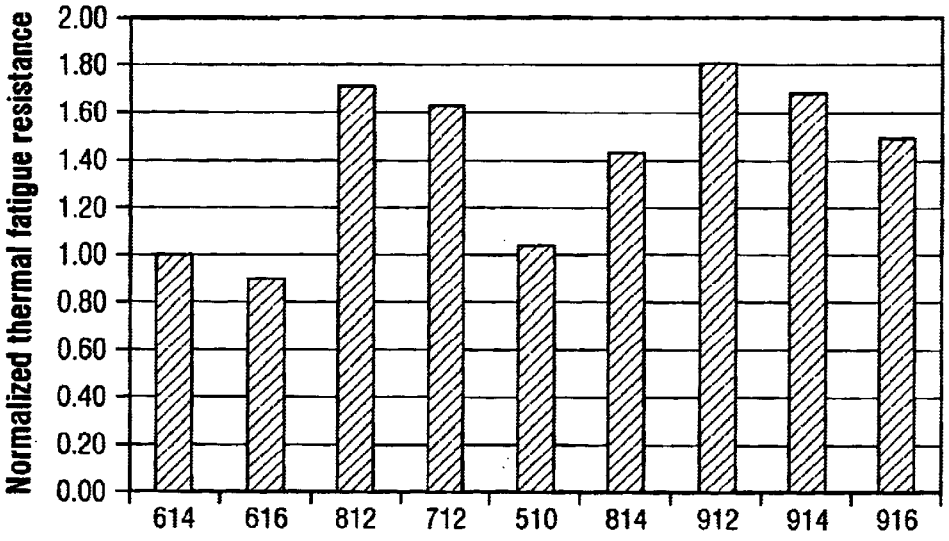
FIG. 6 shows a graphical comparison of normalized fatigue resistance index for conventional carbide bits and carbide bits in accordance with embodiments of the present invention.

FIG. 6 shows a comparison of normalized thermal fatigue resistance index between conventional carbide inserts (indicated by the compound numbers 616, 614, 512, 510, 411, 606, and 311) and the coarse grain carbide of the present invention (indicated by the compound numbers 916, 914, 912, 814, 712, and 812).

In FIG. 6, the coarse grain carbides of the present invention are shown to have increased thermal fatigue resistance as compared to conventional carbide bits.

Control over particle size and cobalt content, therefore, provide a measure of control over the toughness and wear resistance of a particular insert. Accordingly, drill bits may be designed so that inserts having desired properties are selectively positioned on a roller cone. In some embodiments, it may be desirable to position inserts having different toughness and wear resistance properties on different rows. For example, in some embodiments, inserts positioned on interior rows may have a higher toughness and/or wear resistance than inserts positioned on gage rows. However, other inserts arrangements are within the scope of the invention, and theses particular embodiments are not intended to be limiting.

The present invention, therefore, provides a tough, wear resistant insert for use in rock bits. As a result of this, bits made in accordance with the present invention last longer, meaning fewer trips to change the bit, reducing the amount of rig down time, which results in a significant cost saving. In general, these advantages are realized through the selecting appropriate carbide grain size and cobalt content.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A rock bit comprising:

a bit body;

at least one roller cone rotatably coupled to the bit body; and a plurality of cutting elements disposed on the at least one roller cone, wherein at least one of the plurality of cutting elements is disposed on a gage row, wherein the at least one cutting element disposed on the gage row is formed from wear-resistant materials having a binder composition and a coarse grain size such that the at least one cutting element has a fracture toughness of at least 20 ksi $(in)^{0.5}$ and a wear number of at least 1.5.

2. The bit of claim 1, wherein the at least one cutting element has a hardness in a range of about 83 to 85 Rockwell A.

3. The bit of claim 1, wherein the at least one cutting element comprises tungsten carbide.

4. The bit of claim 3, wherein the at least one cutting element comprises at least about 12% by weight cobalt.

5. The bit of claim 4, wherein the at least one cutting element comprises between about 12% to about 16% by weight cobalt.

6. The bit of claim 1, wherein the at least one cutting element has a fracture toughness in the range of about 20 ksi $(in)^{0.5}$ to about 24 ksi $(in)^{0.5}$.

7. An insert for a rock bit, the insert being formed from wear-resistant materials having a binder composition and a coarse grain size such that the insert has a fracture toughness of at least about 20 ksi $(in)^{0.5}$ and a wear number of at least about 1.5.

8. An insert for a rock bit, comprising:

tungsten carbide particles; and a cobalt binder disposed around the particles, wherein a grain size of the tungsten carbide and a cobalt content of the binder are selected to provide a fracture toughness of at least about 20 ksi $(in)^{0.5}$ and a wear number of at least about 1.5.

9. The insert of claim 8, wherein the insert has a hardness in a range of about 83 to 85 Rockwell A.

10. The insert of claim 8, wherein the insert comprises at least about 12% by weight cobalt.

11. The insert of claim 8, wherein the insert comprises between about 12% to about 16% by weight cobalt.

12. The insert of claim 8, wherein the insert has a fracture toughness in the range of about 20 ksi $(in)^{0.5}$ to about 24 ksi $(in)^{0.5}$.

13. A rock bit comprising:

a bit body;

at least one roller cone rotatably coupled to the bit body; and a plurality of cutting elements disposed on the at least one roller cone, wherein at least one of the plurality of cutting elements is disposed on an interior row, wherein the at least one cutting element disposed on the interior row is formed from wear-resistant materials having a binder composition and a coarse grain size such that the at least one cutting element has a fracture toughness of at least 20 ksi $(in)^{0.5}$ and a wear number of at least 1.5.

14. A rock bit comprising:

a bit body;

at least one roller cone rotatably coupled to the bit body; and a first plurality of tungsten carbide gage row cutting elements disposed on the at least one roller cone, a second plurality of tungsten carbide interior row cutting elements disposed on said roller cone, wherein at least one cutting element in the gage row has a lower toughness than the cutting elements in the interior row, and wherein the at least one cutting element in the gage row is formed from wear-resistant materials having a binder composition and a coarse grain size such that the at least one cutting element has a fracture toughness of at least about 20 ksi $(in)^{0.5}$ and a wear number of at least about 1.5.

15. The bit of claim 14, wherein the at least one cutting element in the gage row has a hardness in a range of about 83 to 85 Rockwell A.

16. A rock bit comprising:

a bit body;

at least one roller cone rotatably coupled to the bit body; and a first plurality of tungsten carbide gage row cutting elements disposed on the at least one roller cone, a second plurality of tungsten carbide interior row cutting elements disposed on said roller cone, wherein at least one cutting element in the gage row has a lower wear number than the cutting elements in the interior row, and wherein the at least one cutting element in the gage row is formed from wear-resistant materials having a binder composition and a coarse grain size such that the at least one cutting element has a fracture toughness of at least about 20 ksi $(in)^{0.5}$ and a wear number of at least about 1.5.

17. The bit of claim 16, wherein the at least one cutting element in the gage row has a hardness in a range of about 83 to 85 Rockwell A.

* * * * *